US006009598A

United States Patent [19]

Chang

[11] Patent Number: 6,009,598

[45] Date of Patent: Jan. 4, 2000

[54] ROTATABLE DRAWBAR DEVICE

[76] Inventor: Wen-Chen Chang, 58, Ma Yuan West St., Taichung, Taiwan

[21] Appl. No.: 09/175,104

[22] Filed: Oct. 19, 1998

[51] Int. Cl.[7] ..... A47B 95/02

[52] U.S. Cl. ..... 16/113.1; 16/900

[58] Field of Search ..... 16/113.1, 405, 16/429, 900; 190/115, 116, 39, 18 A; 280/47.315, 47.371

[56] References Cited

U.S. PATENT DOCUMENTS

| | | | |
|---|---|---|---|
| 5,547,053 | 8/1996 | Liang | 16/113.1 |
| 5,581,847 | 12/1996 | Hsieh | 16/113.1 |
| 5,615,757 | 4/1997 | Chen | 16/113.1 |
| 5,647,095 | 7/1997 | Takimoto | 16/438 |
| 5,713,441 | 2/1998 | Chen | 16/900 |
| 5,781,964 | 7/1998 | Lin et al. | 16/113.1 |
| 5,813,504 | 9/1998 | Iny et al. | 16/113.1 |

*Primary Examiner*—Chuck Y. Mah

[57] ABSTRACT

A rotatable drawbar device has a main seat, a rotating seat, a control device, a ring device, a handle bar, an outer pipe, and an inner pipe. The main seat has an opening, an upper flange, an oblong recess, a circular hole, two oblong holes, a rectangular hole, a T-shaped block, and two axle holes. A push button is inserted in the oblong recess. A block seat is inserted in the rectangular hole. A cover panel covers the block seat. The rotating seat is inserted in the opening. A pivot pin fastens the main seat and the rotating seat. The block seat has a T-shaped recess, two lateral bevels, and two oblong recesses receiving two coiled springs. The handle bar has a neck portion, a hollow interior, two confining plates, and a receiving recess receiving the ring device. The inner pipe is inserted in the outer pipe. An upper end of the inner pipe is inserted in the neck portion. The control device is inserted in the inner pipe.

2 Claims, 8 Drawing Sheets

ROTATABLE DRAWBAR DEVICE

BACKGROUND OF THE INVENTION

The present invention relates to a rotatable drawbar device. More particularly, the present invention relates to a rotatable drawbar device for a suitcase.

A conventional extensible drawbar device can be extended or retracted. However, the extensible drawbar device cannot be rotated.

SUMMARY OF THE INVENTION

An object of the present invention is to provide a rotatable drawbar device which can be rotated easily.

Another object of the present invention is to provide a rotatable drawbar device which can be extended.

Another object of the present invention is to provide a rotatable drawbar device which can be retracted.

Accordingly, a rotatable drawbar device comprises a main seat, a rotating seat, a control device, a ring device, a handle bar, an outer pipe, and an inner pipe. The main seat has an opening, an upper flange defining an oblong recess, a circular hole communicating with the oblong recess, two oblong holes communicating with the oblong recess, a rectangular hole, a T-shaped block, two axle holes, and a plurality of round holes. A push button is inserted in the oblong recess. A block seat is inserted in the rectangular hole. A cover panel is disposed on the main seat to cover the block seat. The rotating seat is inserted in the opening. The rotating seat has a pivot portion, a recess hole, and a plurality of radiating catch grooves. The pivot portion has a pivot hole. A pivot pin fastens the main seat and the rotating seat via the axle holes and the pivot hole. The push button has a center bar and two legs. Each of the legs has a bottom bevel. The center bar is inserted in the circular hole. The legs are inserted in the oblong holes. The block seat has a T-shaped recess, two lateral bevels, and two oblong recesses receiving two coiled springs. The T-shaped recess receives the T-shaped block. Each of the lateral bevels matches the respective bottom bevel. The handle bar has a neck portion, a hollow interior, two confining plates, and a receiving recess receiving the ring device. The ring device has a center hole, a bottom notch, and two lateral plates confined by the confining plates. The outer pipe has a first end, a second end, an end frame disposed on the first end, two first round apertures, and two second apertures. The second end of the outer pipe is inserted in the rotating seat. The inner pipe has a circular aperture. The inner pipe is inserted in the outer pipe. An upper end of the inner pipe is inserted in the neck portion of the handle bar. The control device is inserted in the inner pipe. The control device has an extended rod, a control box, a control block, two positioning devices, a cover plate, and a compression spring. The control box is inserted in a lower portion of the inner pipe. The control box has a semicircular hole, an upper interior, two hollow posts, and a lower interior. An upper portion of the control block is inserted in the upper interior. The control block has an upper groove and two pillars. Each of the positioning devices has a column, and an oblong slot receiving the respective pillar. A lower portion of the control block and the positioning devices are inserted in the lower interior. The cover plate has two solid posts engaging with the hollow posts. A lower portion of the extended rod is inserted in the compression spring. The extended rod has a first hook end inserted in the bottom notch and a second hook end inserted in the semicircular hole and the upper groove.

DETAILED DESCRIPTION OF THE INVENTION

Figure 1:
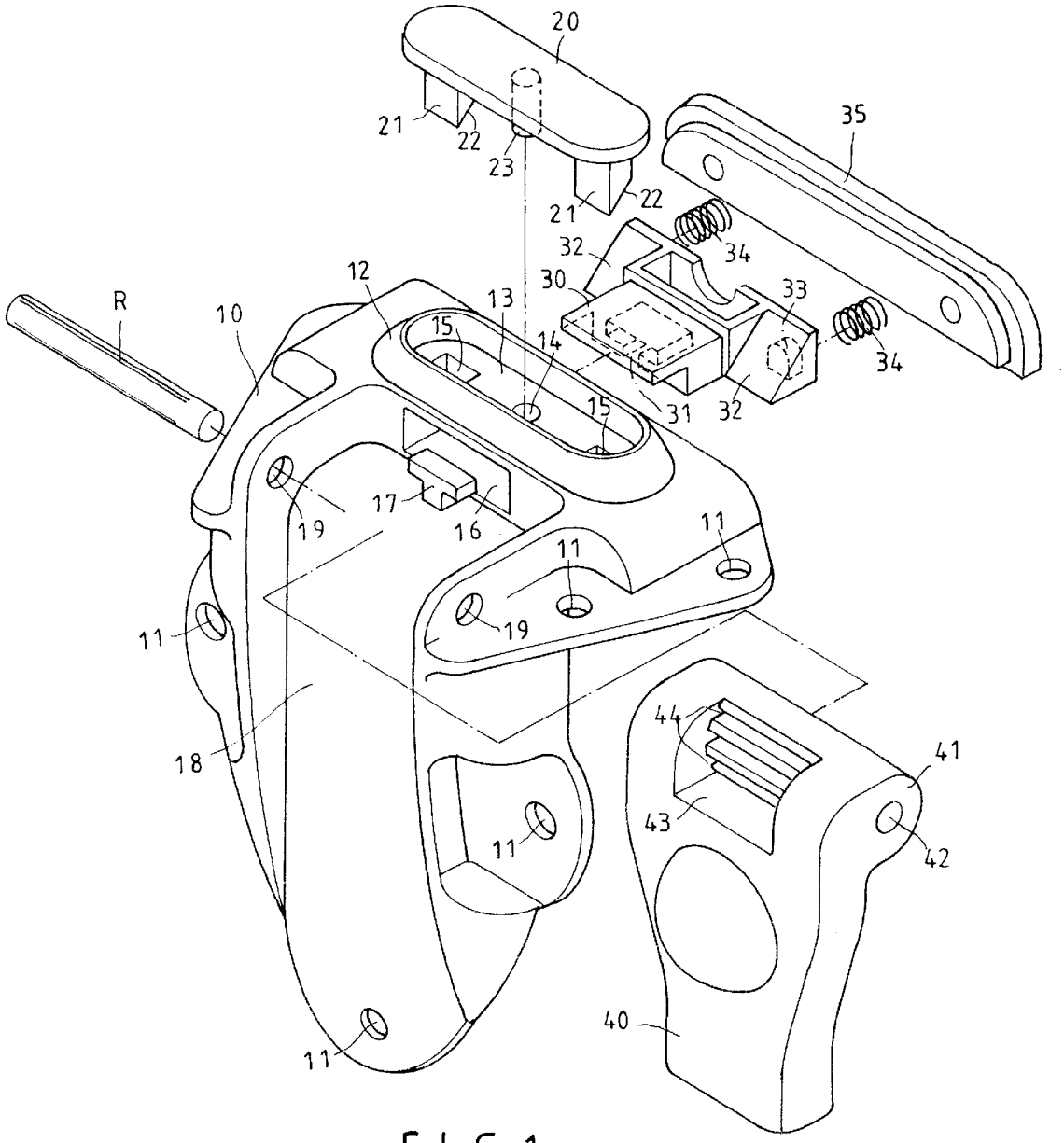
FIG. 1 is a partially perspective exploded view of a rotatable drawbar device of a preferred embodiment in accordance th the present invention.
Figure 2:
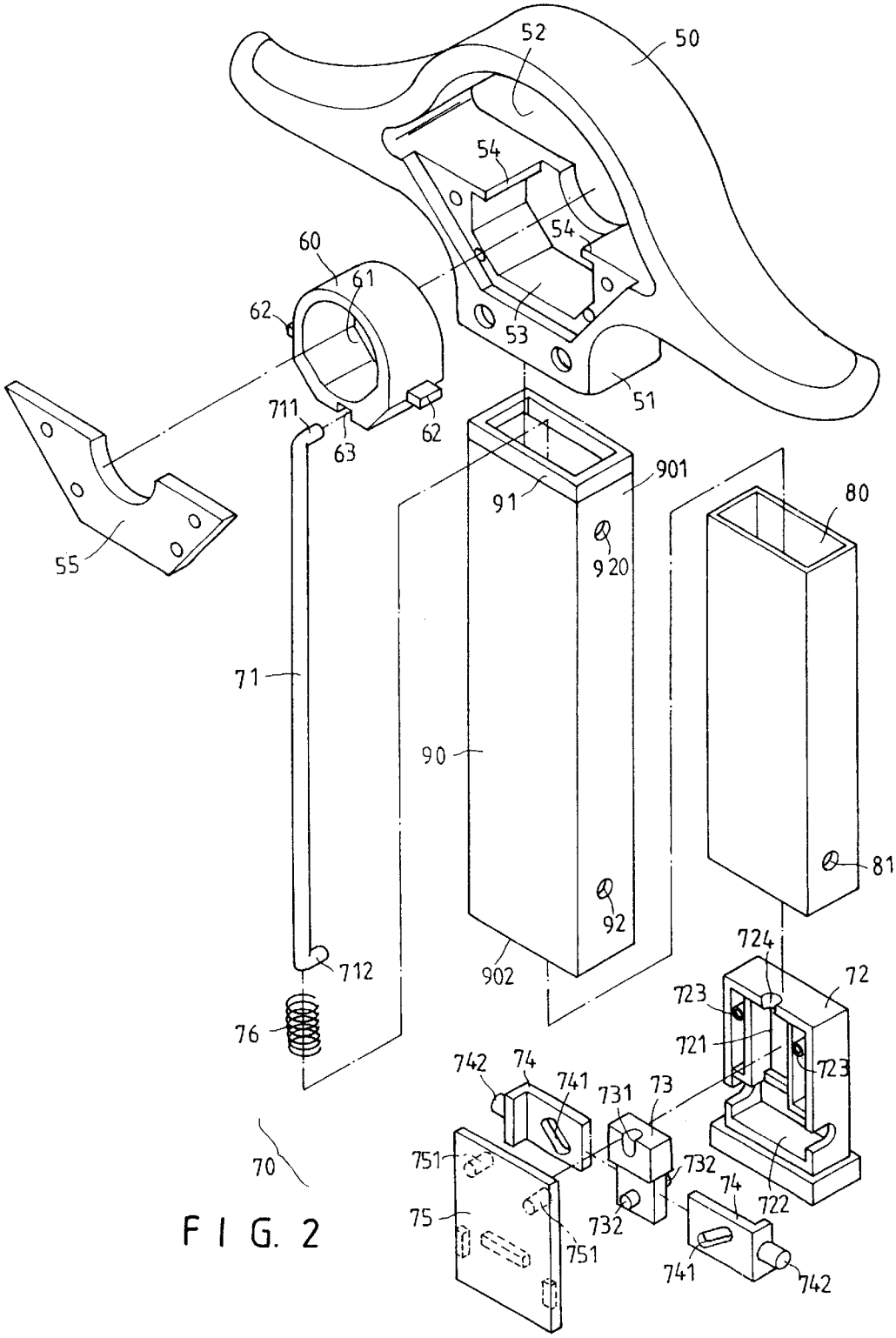
FIG. 2 is another partially perspective exploded view of a rotatable drawbar device of a preferred embodiment in accordance with the present invention.
Figure 3:
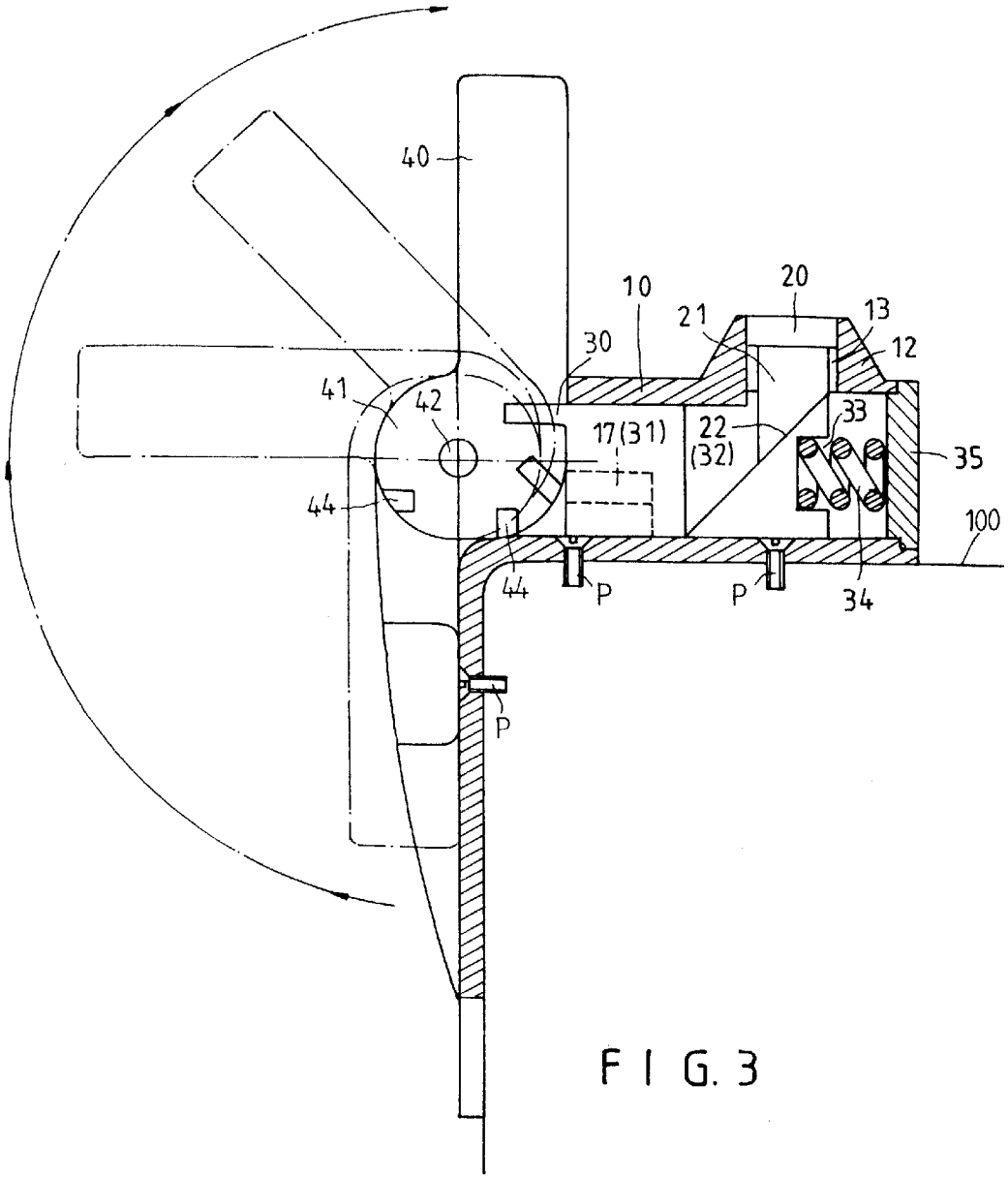
FIG. 3 is a schematic view illustrating an adjustment of an angle of a rotatable drawbar device of a preferred embodiment in accordance with the present invention.
Figure 4:
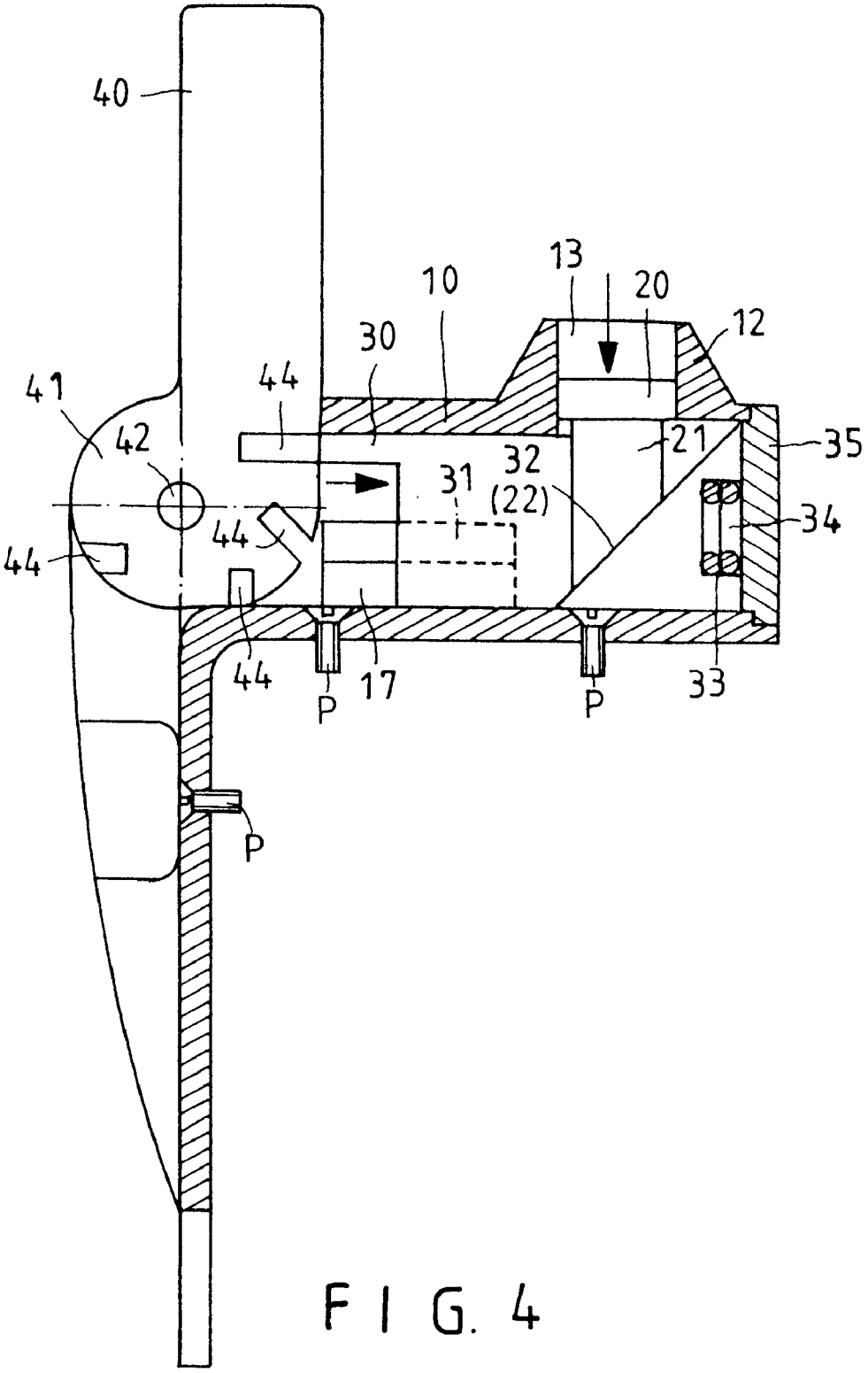
FIG. 4 is a sectional assembly view of FIG. 1.
Figure 5:
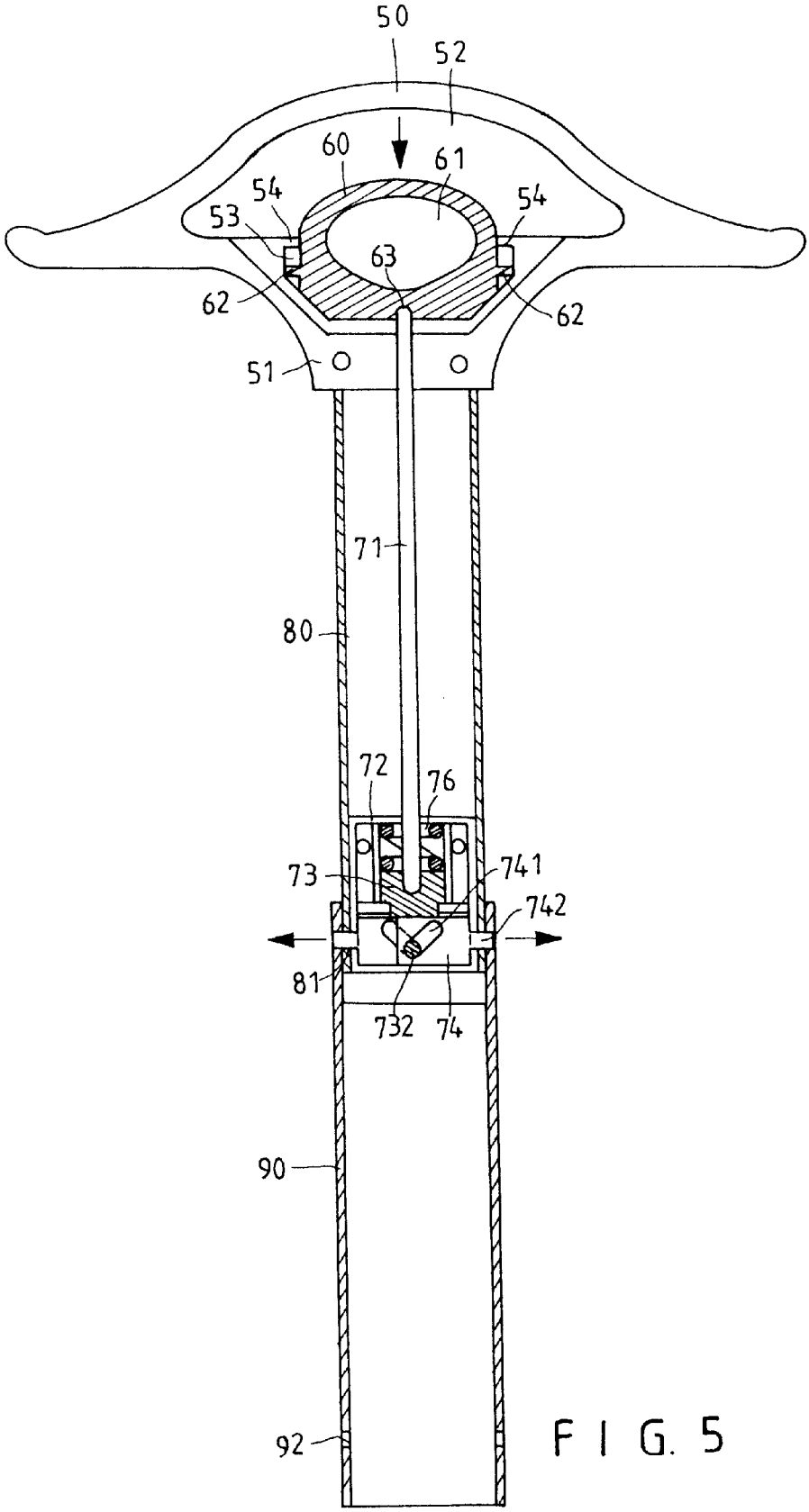
FIG. 5 is a schematic view illustrating a retraction of an angle of a rotatable drawbar device of a preferred embodiment in accordance with the present invention.
Figure 6:
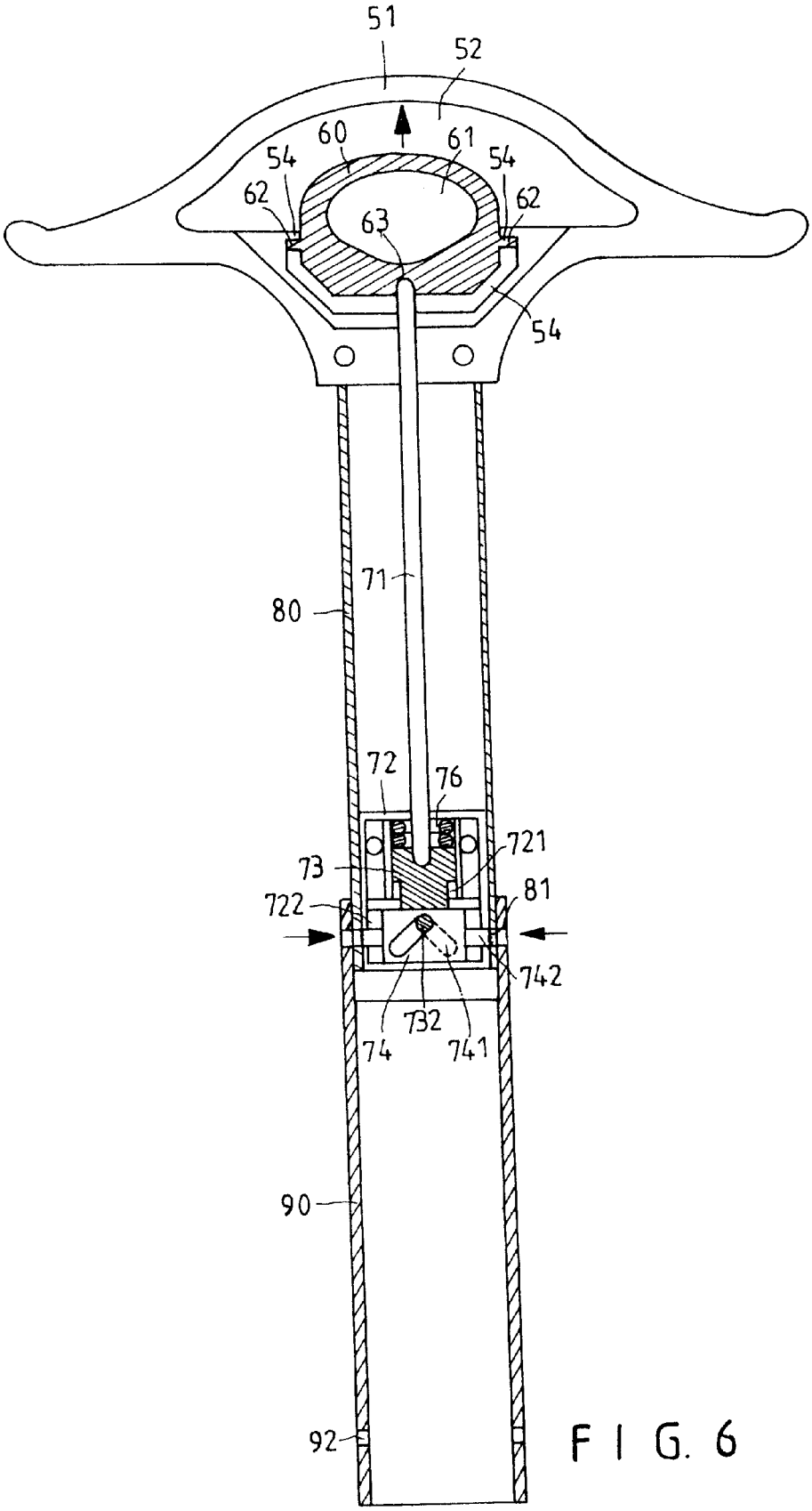
FIG. 6 is a schematic view illustrating an extension of an angle of a rotatable drawbar device of a preferred embodiment in accordance with the present invention.
Figure 7:
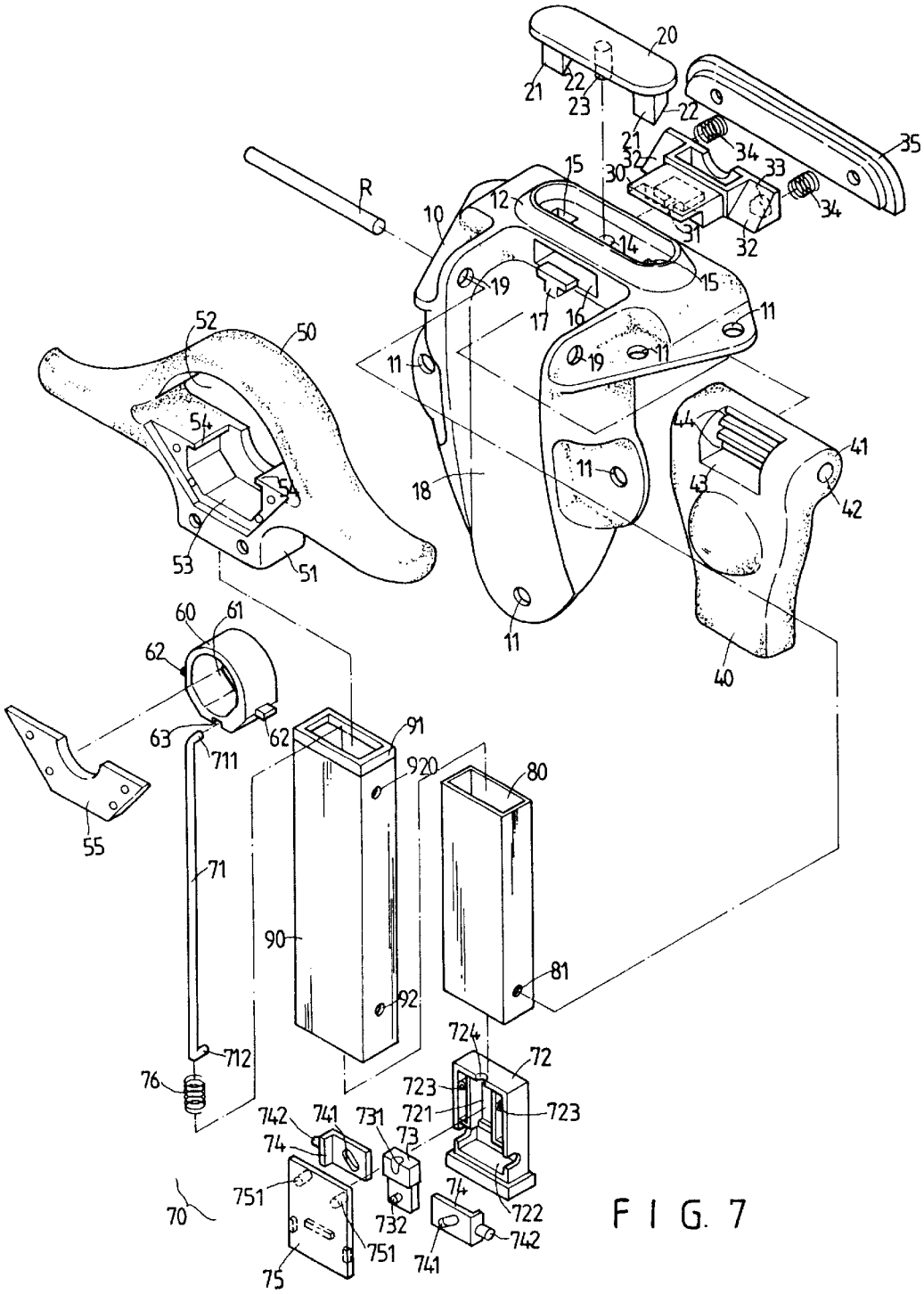
FIG. 7 is a perspective exploded view of a rotatable drawbar device of a preferred embodiment in accordance with the present invention.
Figure 8:
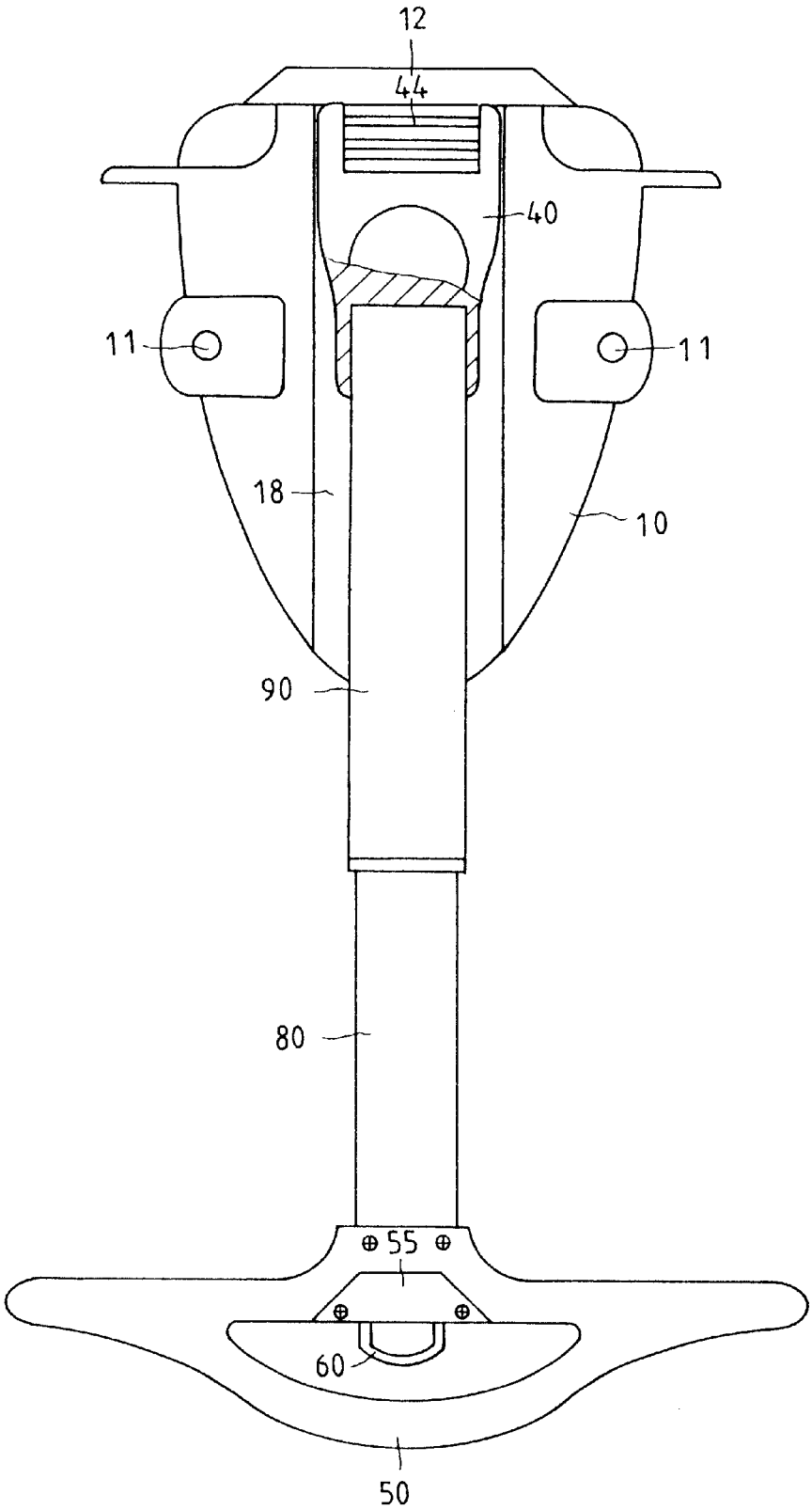
FIG. 8 is an elevational assembly view of a rotatable drawbar device of a preferred embodiment in accordance with the present invention.

Referring to FIGS. 1 to 8, a rotatable drawbar device comprises a main seat 10, a rotating seat 40, a control device 70, a ring device 60, a handle bar 50, an outer pipe 90, and an inner pipe 80.

The main seat 10 has an opening 18, an upper flange 12 defining an oblong recess 13, a circular hole 14 communicating with the oblong recess 13, two oblong holes 15 communicating with the oblong recess 13, a rectangular hole 16, a T-shaped block 17, two axle holes 19, and a plurality of round holes 11. A push button 20 is inserted in the oblong recess 13. A block seat 30 is inserted in the rectangular hole 16. A cover panel 35 is disposed on the main seat 10 to cover the block seat 30. The rotating seat 40 is inserted in the opening 18.

The main seat 10 is disposed on a suitcase 100. A plurality of rivets P fasten the main seat 10 and the suitcase 100 via the round holes 11.

The rotating seat 40 has a pivot portion 41, a recess hole 43, and a plurality of radiating catch grooves 44. The pivot portion 41 has a pivot hole 42. A pivot pin R fastens the main seat 10 and the rotating seat 40 via the axle holes 19 and the pivot hole 42.

The push button 20 has a center bar 23 and two legs 21. Each of the legs 21 has a bottom bevel 22. The center bar 23 is inserted in the circular hole 14. The legs 21 are inserted in the oblong holes 15. The block seat 30 has a T-shaped recess 31, two lateral bevels 32, and two oblong recesses 33 receiving two coiled springs 34. The T-shaped recess 31 receives the T-shaped block 17. Each of the lateral bevels 32 matches the respective bottom bevel 22.

The handle bar 50 has a neck portion 51, a hollow interior 52, two confining plates 54, and a receiving recess 53 receiving the ring device 60.

The ring device 60 has a center hole 61, a bottom notch 63, and two lateral plates 62 confined by the confining plates 54.

The outer pipe 90 has a first end 901, a second end 902, an end frame 91 disposed on the first end 901, two first round apertures 920, and two second apertures 92. The second end 902 of the outer pipe 90 is inserted in the rotating seat 40.

The inner pipe 80 has a circular aperture 81. The inner pipe 80 is inserted in the outer pipe 90. An upper end of the inner pipe 80 is inserted in the neck portion 51 of the handle bar 50.

The control device 70 is inserted in the inner pipe 80. The control device 70 has an extended rod 71, a control box 72, a control block 73, two positioning devices 74, a cover plate 75, and a compression spring 76. The control box 72 is inserted in a lower portion of the inner pipe 80. The control box 72 has a semicircular hole 724, an upper interior 721, two hollow posts 723, and a lower interior 722. An upper portion of the control block 73 is inserted in the upper interior 721. The control block 73 has an upper groove 731 and two pillars 732. Each of the positioning devices 74 has a column 742, and an oblong slot 741 receiving the respective pillar 732. A lower portion of the control block 73 and the positioning devices 74 are inserted in the lower interior 722.

The cover plate 75 has two solid posts 751 engaging with the hollow posts 723.

A lower portion of the extended rod 71 is inserted in the compression spring 76. The extended rod 71 has a first hook end 711 inserted in the bottom notch 63 and a second hook end 712 inserted in the semicircular hole 724 and the upper groove 731. The block seat 30 engages with one of the radiating catch grooves 44. A positioning panel 55 covers the receiving recess 53.

Referring to FIGS. 1 to 4 again, the push button 20 is pressed downward. The block seat 30 disengages from the radiating catch grooves 44. When the push button 20 is not pressed, the block seat 30 engages with one of the radiating catch grooves 44. Therefore, the rotatable drawbar device which can be rotated easily.

Referring to FIGS. 1, 2, 5 and 6 again, the columns 742 are inserted in the circular apertures 81 and the first round apertures 920. When the ring device 60 is pulled upward, the extended rod 71 moves upward. The columns 742 disengage from the first round apertures 920. Then the inner pipe 80 can be extended or retracted easily.

The present invention is not limited to the above embodiment but various modification thereof may be made. Furthermore, various changes in form and detail may be made without departing from the scope of the present invention.

I claim:

1. A rotatable drawbar device comprising:

a main seat, a rotating seat, a control device, a ring device, a handle bar, an outer pipe, and an inner pipe, the main seat having an opening, an upper flange defining an oblong recess, a circular hole communicating with the oblong recess, two oblong holes communicating with the oblong recess, a rectangular hole, a T-shaped block, two axle holes, and a plurality of round holes, a push button inserted in the oblong recess, a block seat inserted in the rectangular hole, a cover panel disposed on the main seat to cover the block seat, the rotating seat inserted in the opening, the rotating seat having a pivot portion, a recess hole, and a plurality of radiating catch grooves, the pivot portion having a pivot hole, a pivot pin fastening the main seat and the rotating seat via the axle holes and the pivot hole, the push button having a center bar and two legs, each of the legs having a bottom bevel, the center bar inserted in the circular hole, the legs respectively inserted in the oblong holes, the block seat having a T-shaped recess, two lateral bevels, and two oblong recesses receiving two coiled springs, the T-shaped recess receiving the T-shaped block, each of the lateral bevels matching the respective bottom bevel, the handle bar having a neck portion, a hollow interior, two confining plates, and a receiving recess receiving the ring device, the ring device having a center hole, a bottom notch, and two lateral plates confined by the confining plates, the outer pipe having a first end, a second end, an end frame disposed on the first end, two first round apertures, and two second apertures, the second end of the outer pipe inserted in the rotating seat, the inner pipe having a circular aperture, the inner pipe inserted in the outer pipe, an upper end of the inner pipe inserted in the neck portion of the handle bar, the control device inserted in the inner pipe, the control device having an extended rod, a control box, a control block, two positioning devices, a cover plate, and a compression spring, the control box inserted in a lower portion of the inner pipe, the control box having a semicircular hole, an upper interior, two hollow posts, and a lower interior, an upper portion of the control block inserted in the upper interior, the control block having an upper groove and two pillars, each of the positioning devices having a column, and an oblong slot receiving the respective pillar, a lower portion of the control block and the positioning devices inserted in the lower interior, the cover plate having two solid posts engaging with the hollow posts, a lower portion of the extended rod inserted in the compression spring, the extended rod having a first hook end inserted in the bottom notch and a second hook end inserted in the semicircular hole and the upper groove.

2. A rotatable drawbar device as claimed in claim 1, wherein a positioning panel covers the receiving recess.

* * * * *